US005244614A

United States Patent [19]

Hagen

[11] Patent Number: 5,244,614

[45] Date of Patent: Sep. 14, 1993

[54] PROCESS OF MAKING MULTICOMPONENT TRILOBAL FIBER

[75] Inventor: Gerry A. Hagen, Anderson, S.C.

[73] Assignee: BASF Corporation, Parsippany, N.J.

[21] Appl. No.: 767,169

[22] Filed: Sep. 26, 1991

[51] Int. Cl.[5] ..... D01D 5/34; D01F 1/04; D01F 8/04; D01F 8/12

[52] U.S. Cl. ..... 264/78; 264/171; 264/177.13; 425/131.5

[58] Field of Search ..... 264/78, 171, 177.13; 425/131.5

[56] References Cited

U.S. PATENT DOCUMENTS

| | | | |
|---|---|---|---|
| 3,188,689 | 6/1965 | Breen | 425/463 |
| 3,418,200 | 12/1968 | Tanner | 428/373 |
| 3,480,996 | 12/1969 | Matsui | 425/131.5 |
| 3,601,846 | 8/1971 | Hudnall | 425/131.5 |
| 3,618,166 | 11/1971 | Ando et al. | 425/462 |
| 3,671,379 | 6/1972 | Evans et al. | 428/362 |
| 3,672,802 | 6/1972 | Matsui et al. | 425/131.5 |
| 3,700,544 | 10/1972 | Matsui | 428/373 |
| 3,709,971 | 1/1973 | Shimoda et al. | 264/182 |
| 3,716,317 | 2/1973 | Williams, Jr. et al. | 425/198 |
| 4,370,114 | 1/1983 | Okamoto et al. | 425/131.5 |
| 4,406,850 | 9/1983 | Hills | 264/171 |
| 4,411,852 | 10/1983 | Bromley et al. | 264/171 |
| 4,738,607 | 4/1988 | Nakajima et al. | 425/131.5 |
| 5,125,818 | 6/1992 | Yeh | 425/131.5 |

*Primary Examiner*—Leo B. Tentoni
*Attorney, Agent, or Firm*—Karen M. Dellerman

[57] ABSTRACT

A method of producing a multicomponent trilobal fiber includes providing a trilobal capillary defining three legs, three apexes and an axial center, directing a first molten polymer composition to the axial center and presenting a second molten polymer composition to at least one of the apexes. The fiber produced has a trilobal core defining an outer core surface and a sheath abutting at least about one-third of the outer core surface.

11 Claims, 5 Drawing Sheets

PROCESS OF MAKING MULTICOMPONENT TRILOBAL FIBER

FIELD OF THE INVENTION

This invention relates generally to synthetic polymer filaments. More particularly, this invention relates to multicomponent trilobal fibers and a process for making the same.

BACKGROUND OF THE INVENTION

As used herein, the term "fiber" includes fibers of extreme or indefinite length (filaments) and fibers of short length (staple). The term "yarn" refers to a continuous strand of fibers.

"Modification ratio" means the ratio $R_1/R_2$ where $R_2$ is the radius of the largest circle that is wholly within a transverse cross-section of a fiber, and $R_1$ is the radius of the circle that circumscribes the transverse cross-section.

"Trilobal fiber" means a three-lobed fiber having a modification ratio of at least 1.4.

"Polymer composition" means any specific thermoplastic polymer, copolymer or polymer blend including additives, if any.

Fibers which have a trilobal cross-section are known to be superior in many properties to those having a round cross-section.

It is also known that combining two or more different polymeric components, whether the differences result from differences in additives or in the base polymer itself, produces fibers with improved properties for many end uses. For example, composite polyester fibers which are self-crimpable are disclosed in U.S. Pat. No. 3,671,379 to Evans et al.

Also, U.S. Pat. No. 3,418,200 to Tanner describes a tipped multilobal composite fiber which is readily splittable. U.S. Pat. No. 3,700,544 to Matsui discloses composite sheath/core fibers having improved flexural rigidity. One of the cross-sections disclosed by Matsui is a triangular sheath/core fiber. These patents are merely examples of the variety of effects which can be achieved with multicomponent fibers.

Methods and apparatus for preparing multicomponent fibers are also known. Exemplary apparatus are shown in U.S. Pat. Nos. 3,188,689 to Breen, 3,601,846 to Hudnall, 3,618,166 to Ando et al., 3,672,802 to Matsui et al., 3,709,971 to Shimoda et al., 3,716,317 to Williams, Jr. et al., 4,370,114 to Okamoto et al., 4,406,850 to Hills, and 4,738,607 to Nakajima et al.

As is demonstrated from the previous patents, a great deal of effort has been directed to developing multicomponent fibers, as well as methods and apparatus for producing them. Yet sheath/core trilobal fibers are not presently produced effectively and with sufficient uniformity and efficiency. Also, there has been a lack of the ability to adjust the sheath components in any versatile manner. Thus, there remains a need for a method for producing a sheath/core trilobal fiber where the ratio of sheath to core is relatively accurately controlled as is the composition of the sheath component itself. It is believed that the fibers produced by such a method will find great utility in various applications.

SUMMARY OF THE INVENTION

The present invention is a method of producing a multicomponent trilobal fiber by providing a trilobal capillary defining three legs, three apexes and an axial center, directing a first molten polymer composition to the axial center and presenting a second molten polymer composition to at least one of the apexes so that the fiber has a core defining an outer trilobal core surface and a sheath abutting at least about one-third of the outer core surface.

It is an object of the present invention to provide an improved process for preparing trilobal sheath/core composite fibers.

A further object of the present invention is to provide a trilobal sheath/core composite fiber.

After reading the following description, related objects and advantages of the present invention will be apparent to those ordinarily skilled in the art to which the invention pertains.

DETAILED DESCRIPTION OF THE FIGURES

DETAILED DESCRIPTION OF THE PREFERRED EMBODIMENTS

To promote an understanding of the principles of the present invention, descriptions of specific embodiments of the invention follow and specific language describes the same. It will nevertheless be understood that no limitation of the scope of the invention is thereby intended, and that alterations and further modifications, and further applications of the principles of the invention as discussed are contemplated as would normally occur to one ordinarily skilled in the art to which the invention pertains.

Applicant has discovered that, surprisingly, sheath/core trilobal fibers can be melt spun by routing molten sheath polymer to at least one apex of a trilobal spinneret orifice. There are many particular means which can be used to accomplish the objective and one of ordinary skill in the art would readily understand that the present invention is not limited to any one particular manner of routing the sheath polymer to the apex of the trilobal spinneret.

Figure 1:
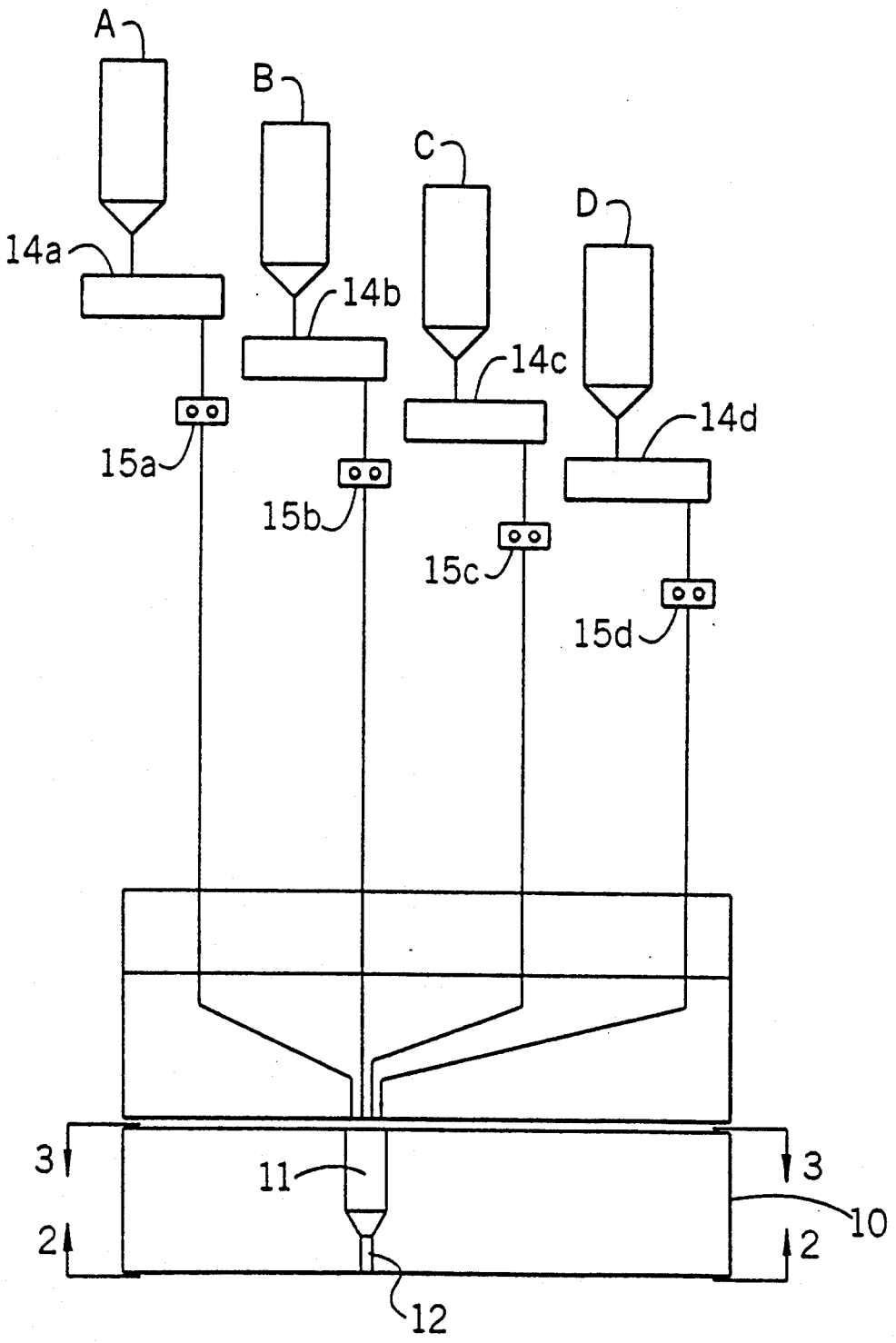
FIG. 1 is a schematic representation of the process of the present invention showing four polymer melt streams independently metered to a trilobal capillary.

By way of illustration, FIG. 1 schematically represents the routing process of the present invention. Portion 10 of a spinneret plate shows one capillary 11 and trilobal orifice 12. Individual molten polymer streams A, B, C and D are shown. Each molten polymer stream may be separately metered to spinneret capillary 11. The general route of each molten polymer stream to capillary 11 is shown with lines. As depicted in FIG. 1, each molten polymer stream, A, B, C and D, has its own extruder 14*a*, 14*b*, 14*c* and 14*d*, respectively, and metering pumps 15*a*, 15*b*, 15*c* and 15*d*, respectively. When each polymer stream is equipped with its own extruder and metering pump, a large variety of trilobal cross-sections are possible. This will be apparent from the following discussion.

Figure 2:
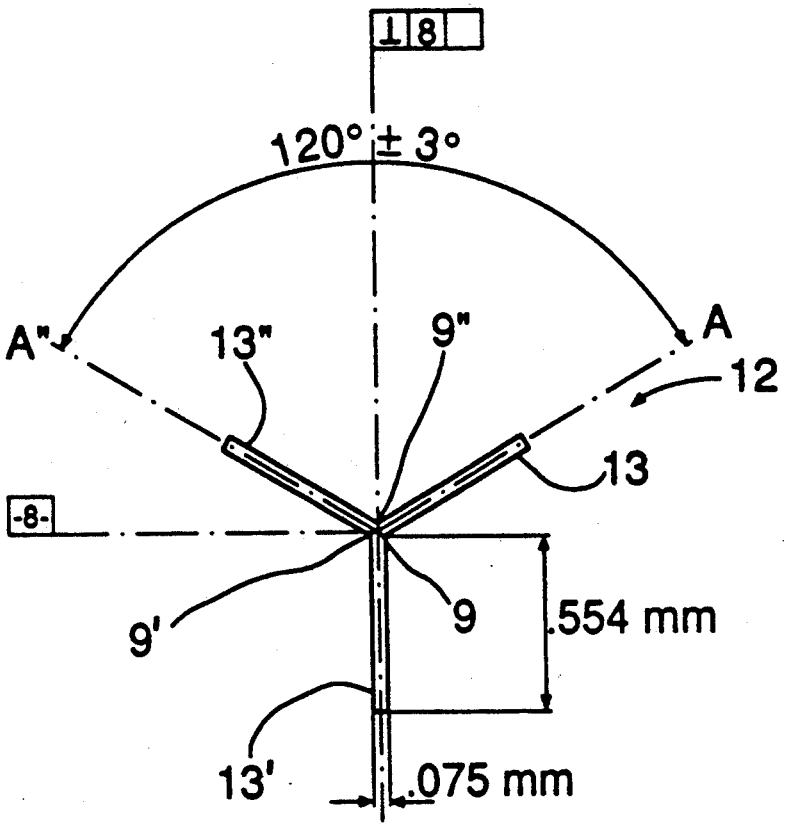
FIG. 2 is a bottom plan view of a spinneret capillary useful in the invention shown in FIG. 1 and looking in the direction of arrows 2—2.

FIG. 2 is a bottom plan view of a trilobal capillary useful in the present invention and taken looking in the direction of arrows 2—2 in FIG. 1. Shown in trilobal orifice 12. Trilobal orifice 12 has three legs, 13, 13' and 13". Between each leg there is an apex, a, a' and a", respectively, as shown in FIG. 2. While the dimensions of the capillary are not critical, suitable capillary dimensions are such that each leg is about 0.554 mm long and about 0.075 mm wide. The depth of the capillary is 0.250 mm. The angle between longitudinal axis of each leg may be about 120°.

Figure 3:
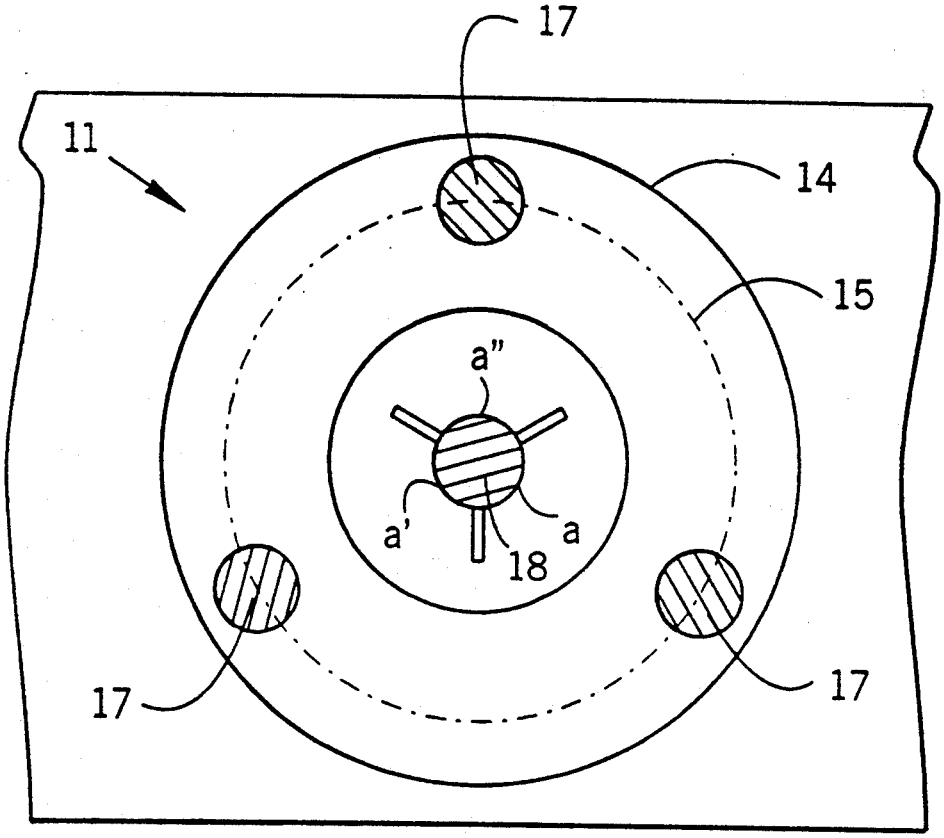
FIG. 3 is a cross-sectional view of the schematic of FIG. 1 taken along line 3—3 and looking in the direction of the arrows.
Figure 3:
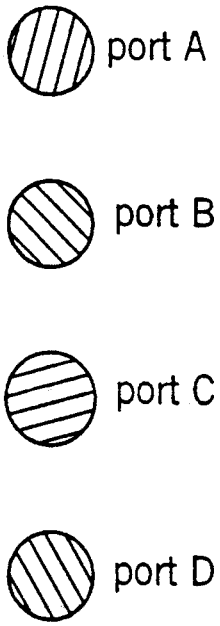

Turning to FIG. 3, a schematic cross-sectional view taken along line 3—3 of FIG. 1 and looking in the direction of the arrows is shown. Shown in the view is capillary entrance bore 14 which may be on the order of 4.3 mm in diameter. Port circle 15 has a diameter of about 2 mm. All apexal ports 17 and central port 18 which feed individual molten polymer streams to capillary 11 may be on the order of 0.60 mm in diameter. It should be recognized that while specific dimensions of ports, capillaries, orifices, etc., are made, these dimensions are not intended to limit the present invention but merely to fairly illustrate it. Other suitable dimensions may be scaled as will be readily apparent to those skilled in the art to which the invention pertains.

To practice the invention, polymer stream C is directed through central port 18 to the center of trilobal orifice 12, where, after extrusion, stream C forms a trilobal core. Polymer streams A, B and D are presented to apex a', a" and a, respectively, through apexal port 17 where, after extrusion, the streams A, B and D form a sheath abutting the trilobal core. Depending on the amount of polymer metered to each apex, the sheath shape is easily varied in a predetermined manner. For example, if no polymer is routed to apex a, then the sheath of the fiber defined by apex a' and a" will surround only about two-thirds of the outer core surface formed by polymer stream C.

Figure 4:
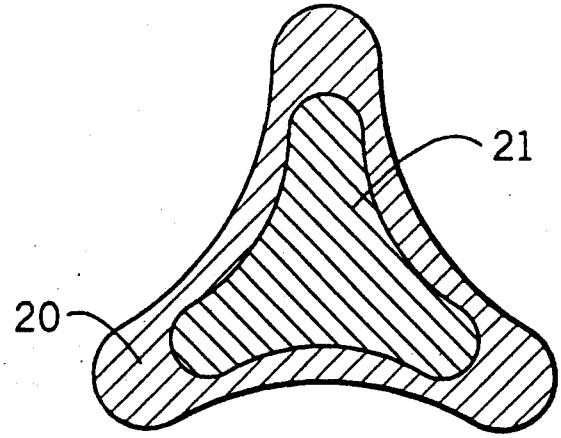
FIG. 4 is a greatly magnified cross-sectional view of a two component sheath/core trilobal composite fiber of the present invention demonstrating an even sheath.

When polymer is fairly evenly metered to each apex, the resulting sheath/core trilobal has a sheath which occupies an approximately even perimeter around the core as demonstrated in FIG. 4. Polymer metered to an apex is, surprisingly, distributed approximately evenly over the lengths of the adjoining legs. Polymer metered to other apexes in approximately equal amounts results in a uniform sheath perimeter 20 surrounding the outer surface of trilobal core 21. The sheath produced from each apex stream is found to meet consistently at the leg tips of the extrusion orifice.

Figure 5:
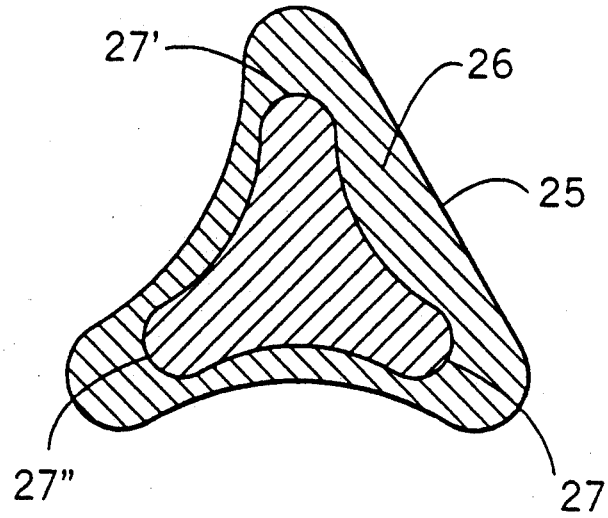
FIG. 5 is a greatly magnified cross-sectional view of a sheath/core trilobal composite fiber of the present invention demonstrating an uneven sheath.

Another feature of the process is the ability to prepare sheath/core fibers having relatively thicker portions of sheath in a predetermined manner as demonstrated, but somewhat exaggerated, in FIG. 5. For example, if polymer D is metered in an amount to apex a, then A and B are metered to apexes a' and a" in a lesser amount, the resulting filament has uneven sheath 25. The portion 26 of the sheath 25 defined by lobes 27 and 27' is thicker than that sheath portion defined by either 27' and 27" or 27" and 27. Lobes 27, 27' and 27" represent polymer extruded through legs 13, 13' and 13", respectively.

Also, as noted, it is not necessary that all three apexal ports are utilized. Depending on the desired result, one or two of the apexal ports may be used to present molten polymer to the apexes of the trilobal spinneret orifice.

Figure 6:
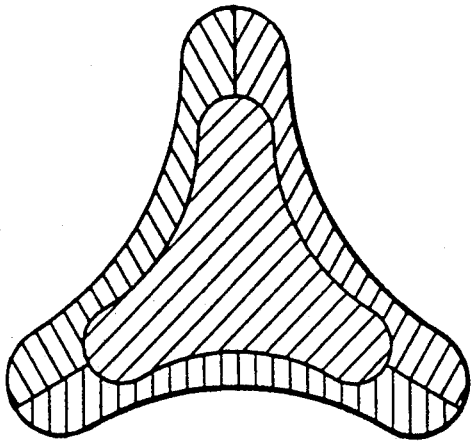
FIG. 6 is a greatly magnified cross-sectional view of a four-component sheath/core trilobal fiber of the present invention.

As another feature of the process anywhere between two and four different polymer compositions can be metered to a, a', a" and to the core to prepare a sheath-/core trilobal having a multicomponent sheath as shown in FIG. 6.

The polymer compositions may be composed of different compatible or compatibilized polymer bases or may differ by the additives, such as pigments, that are added through each route. One advantage of this process is that additives can be present in a single fiber but in different portions of the sheath. One particularly preferred aspect is where each polymer is of the same type or family, for example all nylon or all nylon 6, and the difference is in pigmentation.

Apart from the novel routing of polymers to a spinneret capillary which are a part of the present invention, the other processing parameters used may be those established for the polymer being extruded. For example, when the present invention is used to make trilobal nylon 6 fibers, known nylon 6 melt spinning conditions may be used.

Another embodiment of the present invention concerns a multicomponent sheath/core trilobal fiber where the sheath occupies an approximately even perimeter around the fiber. This sheath may be anywhere from about 10 to about 90 percent sheath, preferably about 15 to about 50 percent sheath. The modification ratio of the trilobal is preferably greater than about 1.4 and more preferably between 2 and 4. Such fiber may be pigmented in at least one of the core or sheath components or both. Such a fiber is illustrated in FIG. 4.

Such sheath/core trilobal fibers can be made by the process of the present invention. Melt spinning conditions may be used as are known for the type of polymer composition being extruded.

The fiber-forming polymers that can be used in the process and fiber of the present invention are high molecular weight substances having a fiber-forming property such as polyamides and their copolymers, polyethylene terephthates and their copolymers and polyolefins. After extrusion, the filaments are processed according to known fiber processing techniques suitable for any end use. The methods of processing will depend upon the intended use and will be according to conventional processes known to those ordinarily skilled in the art. Examples are draw-winding and spin-draw-winding processes.

EXAMPLES 1–4

Four independent extruders, each having an independently controlled gear pump, supply four molten nylon 6 streams at 265° C. to a spinning assembly. The four molten nylon 6 streams are individually metered to discrete portions of a trilobal spinneret capillary. Three of the streams are metered to the apexes of the capillary lobes and one polymer stream is metered to the core. All compositions are nylon 6 and are made, extruded and metered according to standard nylon 6 melt spinning conditions.

The polymer streams vary in composition. These compositions and the metering volumes of each are presented in TABLE 1. The cross-sections achieved by the metering schemes are shown in the figures as indicated.

All clear components are natural nylon 6. The red, blue, gray and gold compositions refer to pigmented nylon 6. All four metering schemes produce sheath-/core trilobal fibers suitable for drawing, texturing and use in a product such as carpet yarn.

TABLE 1

| Example | No./Type Component | Flow (g/min) | % Volume | Cross-Section |
|---|---|---|---|---|
| 1. Colored core/ uniform clear sheath | 2 per capillary | | | FIG. 7 |
| Port A | Clear | 0.379 | 11 | |
| Port B | Clear | 0.379 | 11 | |
| Port C | Red | 2.310 | 67 | |
| Port D | Clear | 0.379 | 11 | |
| 2 Colored uniform sheath/clear core | 2 per capillary | | | FIG. 4 |
| Port A | Red | 0.448 | 13 | |
| Port B | Red | 0.448 | 13 | |
| Port C | Clear | 2.103 | 61 | |
| Port D | Red | 0.448 | 13 | |
| 3. Non-uniform sheath | 4 per capillary | | | FIG. 8 |
| Port A | Gold | 0.831 | 24.1 | |
| Port B | Red | 0.355 | 10.3 | |
| Port C | Gray | 1.669 | 48.4 | |
| Port D | Blue | 0.593 | 17.2 | |
| 4. Non-uniform sheath | 3 per capillary | | | FIG. 9 |
| Port A | Gold | 0.831 | 24.1 | |
| Port B | Red | 0.355 | 10.3 | |
| Port C | Clear | 1.131 | 32.8 | |
| Port D | Clear | 1.131 | 32.8 | |

What is claimed is:

1. A method of producing a multicomponent trilobal fiber comprising:

a) providing a trilobal capillary defining three legs, three apexes and an axial center;

b) directing a first molten polymer composition to the axial center;

c) presenting a second molten polymer composition to at least one of the apexes; and d) extruding through the capillary, the first and second compositions to form a multicomponent trilobal fiber having a core of the first composition defining a core and a sheath formed from the second polymer composition abutting at least about one-third of the core surface.

2. The method of claim 1 further comprising pigmenting at least one of the molten polymer compositions prior to said directing or presenting.

3. The method of claim 1 where the second molten polymer composition is presented to at least two of the apexes so that the sheath abuts at least about two-thirds of the outer core surface.

4. The method of claim 3 wherein the second molten polymer composition is presented to all three apexes so that the sheath completely surrounds the outer core surface.

5. The method of claim 1 further comprising presenting a third molten polymer composition to at least one of the apexes to form a tricomponent trilobal fiber having a single polymer composition core and at least two polymer compositions in the sheath, the sheath abutting at least two-thirds of the outer core surface.

6. The method of claim 5 further comprising presenting a fourth molten polymer composition to at least one of the apexes to form a four component trilobal fiber having a single polymer composite core and three polymer compositions in the sheath, the sheath completely surrounding the core.

7. The method of claim 2 further comprising pigmenting at least two molten polymer compositions and presenting a third molten polymer composition to at least one of the apexes to form a tricomponent trilobal fiber having a single polymer composition core and at least two polymer compositions in the sheath, the sheath abutting at least two-thirds of the outer core surface.

8. The method of claim 7 further comprising presenting a fourth molten polymer composition to at least one of the apexes to form a four component trilobal fiber having a single polymer composite core and three polymer compositions in the sheath, the sheath completely surrounding the core.

9. The method of claim 3 wherein said presenting is by metering the second molten polymer composition and the second molten polymer composition is metered in a greater amount to at least one of the apexes so that the trilobal fiber has a nonuniform sheath abutting at least two-thirds of the outer core surface.

10. The method of claim 5 wherein said presenting is by metering the second and third polymer compositions and at least one of the second or third compositions is metered in a greater amount to at least one apex so that the trilobal fiber has a two component non-uniform sheath abutting at least two-thirds of the outer core surface.

11. The method of claim 8 wherein said presenting is by metering the second, third and fourth polymer compositions and at least one of the second, third or fourth polymer compositions is metered in a greater amount so that the trilobal fiber has a nonuniform three component sheath completely surrounding the core.

* * * * *

UNITED STATES PATENT AND TRADEMARK OFFICE

CERTIFICATE OF CORRECTION

PATENT NO. : 5,244,614

DATED : September 14, 1993

INVENTOR(S) : Gerry A. Hagen

Figure 7:
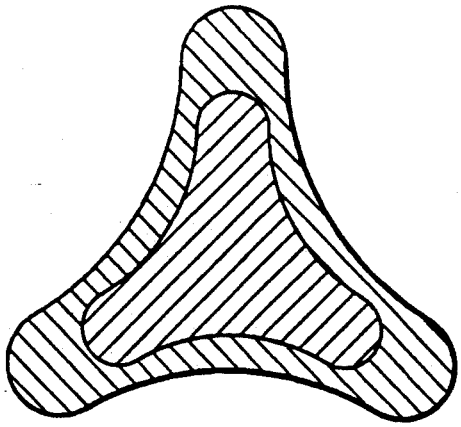
FIG. 7 is a cross-sectional view of a trilobal fiber of the present invention having a uniform uncolored sheath surrounding a colored core.
Figure 8:
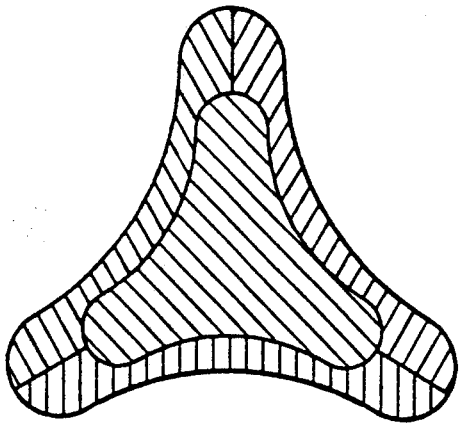
FIG. 8 is a cross-sectional view of a trilobal fiber of the present invention and having a non-uniform three-component sheath surrounding a colored core.
Figure 9:
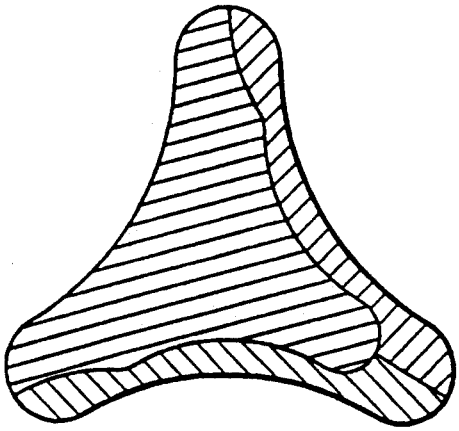
FIG. 9 is a cross-sectional view of a trilobal fiber of the present invention and having a two-component sheath partially surrounding an uncolored core.
Figure 7:
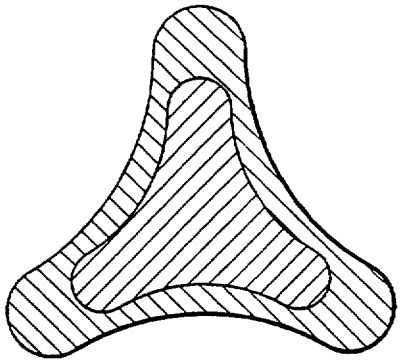
Figure 8:
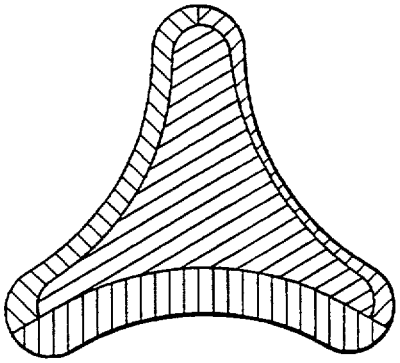
Figure 9:
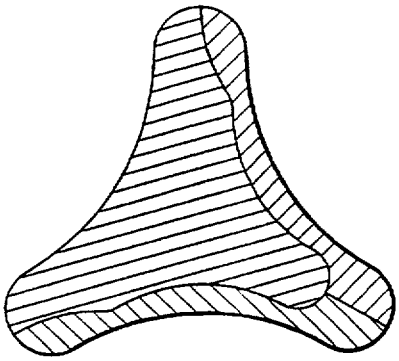

It is certified that error appears in the above-identified patent and that said Letters Patent is hereby corrected as shown below:

The Drawing Sheet, consisting of Figs 7,8, and 9, should be deleted to be replaced with the Drawing Sheet, consisting of Figs. 7,8, and 9, as shown on the attached page.

Signed and Sealed this

Eighth Day of November, 1994

Bruce Lehman

*Attest:*

BRUCE LEHMAN

*Attesting Officer*

*Commissioner of Patents and Trademarks*